US005570479A

United States Patent [19]

Chomik et al.

[11] Patent Number: 5,570,479

[45] Date of Patent: Nov. 5, 1996

[54] TOILET SEAT-BIDET ASSEMBLY

[75] Inventors: Richard S. Chomik, Garwood, N.J.; Francis T. Pieters, Pointe Claire, Canada; Salvatore C. Petralia, Sayreville, N.J.

[73] Assignee: Sydson & Cavaliers, Inc., Quebec, Canada

[21] Appl. No.: 431,754

[22] Filed: May 1, 1995

Related U.S. Application Data

[63] Continuation-in-part of Ser. No. 338,139, Nov. 9, 1994, abandoned.

[51] Int. Cl.[6] ..... A61H 33/00

[52] U.S. Cl. ..... 4/420.2; 4/420.4; 4/447

[58] Field of Search ..... 4/420.1–420.5, 4/443–448

[56] References Cited

U.S. PATENT DOCUMENTS

| | | | |
|---|---|---|---|
| 1,633,281 | 6/1927 | Nielsen | 4/248 |
| 2,875,450 | 3/1959 | Umann | 4/447 |
| 3,247,524 | 4/1966 | Umann | 4/447 X |
| 3,545,015 | 12/1970 | Richardson et al. | 4/447 |
| 3,995,326 | 12/1976 | Umann | 4/420.1 |
| 4,237,560 | 12/1980 | Riegelman et al. | 4/447 |
| 4,321,715 | 3/1982 | Baus | 4/420.2 |
| 4,393,525 | 7/1983 | Kondo | 4/420.2 |
| 4,422,190 | 12/1983 | Huang | 4/420.3 |
| 4,761,836 | 8/1988 | Tsutsui et al. | 4/420.2 |
| 4,850,060 | 7/1989 | Kou | 4/237 |
| 4,933,997 | 6/1990 | Kaneko | 4/420.4 |
| 5,279,001 | 1/1994 | Vento | 4/447 |

*Primary Examiner*—Robert M. Fetsuga

*Attorney, Agent, or Firm*—Birch, Stewart, Kolasch & Birch, LLP

[57] ABSTRACT

A toilet seat bidet assembly including a toilet seat mounted for pivoting movement about a rear hinge, the toilet seat including a flow control, water heater, thermostat, water diverter, front and rear nozzles, with at least the rear nozzle being retractable, air blower and air heater for heating the air, all in the confines of the toilet seat, and a friction hinge with slow damping downward pivoting movement with effortless upper pivoting movement.

7 Claims, 4 Drawing Sheets

FIG. 1
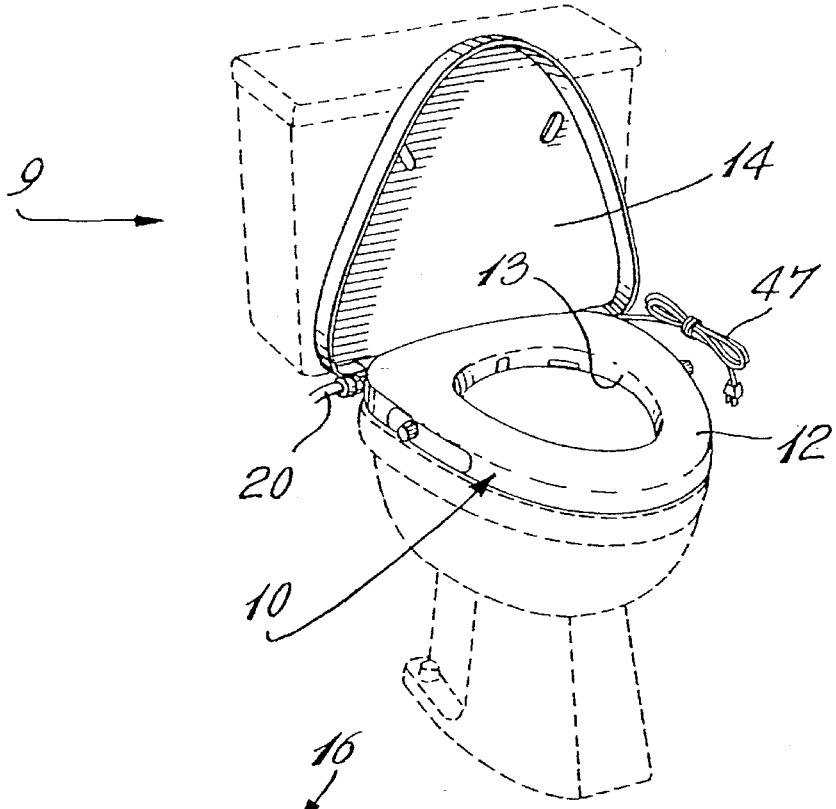
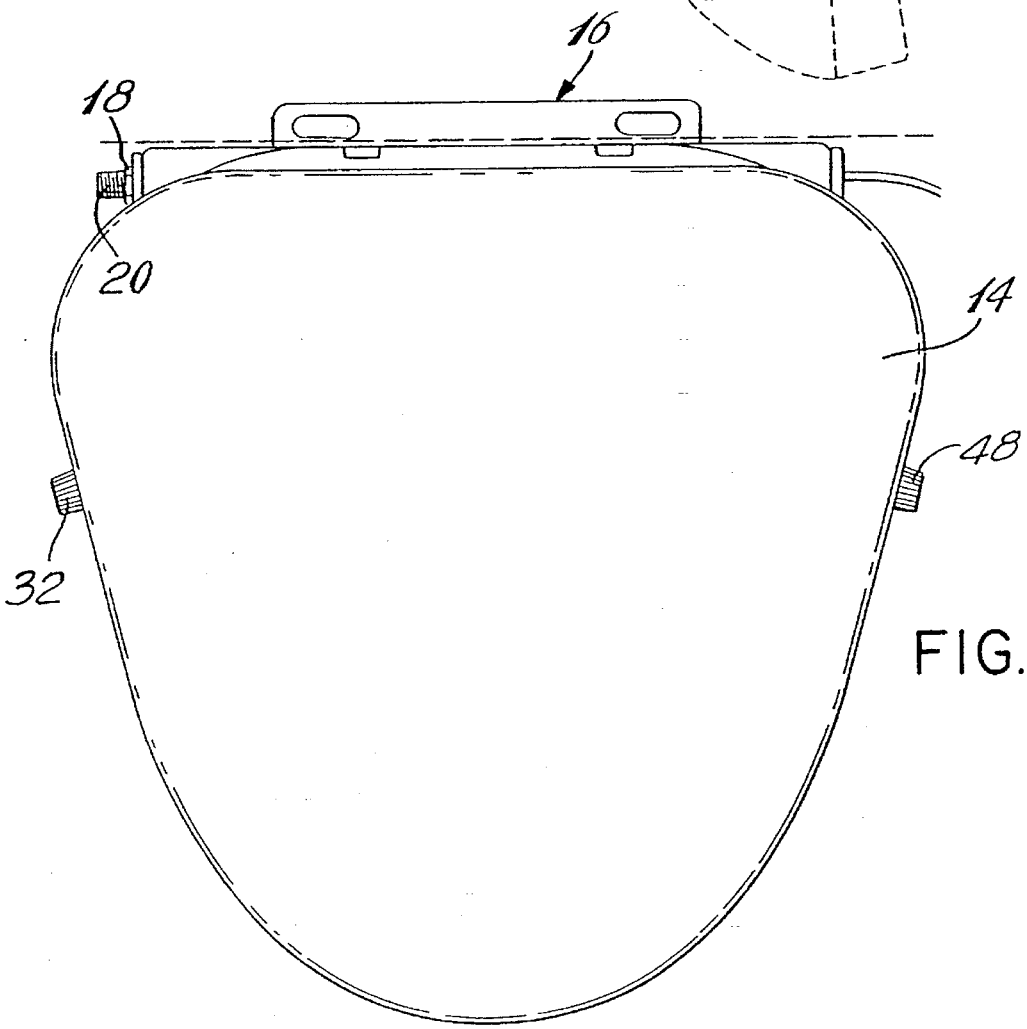
FIG. 2

TOILET SEAT-BIDET ASSEMBLY

CROSS-REFERENCE TO RELATED APPLICATIONS

The present application is a continuation-in-part application of application Ser. No. 08/338,139, filed Nov. 9, 1994, abandoned.

BACKGROUND OF THE INVENTION

1. Field of the Invention

The present invention relates to toilets and more particularly to a toilet seat and bidet combination.

2. Description of the Prior Art

Bidets have been utilized for many years as a hygienic bathroom accessory. In recent years, in order to adapt to generally smaller, modern bathrooms, suggestions have been made to incorporate bidet components in toilet seats for conventional toilets. Such toilet seat bidet combinations require a source of water, a heating device for controlling the temperature of the water, and a nozzle set in the toilet seat for directing the water as a jet towards the private parts to be washed. Examples of such combination toilet seat-bidets are illustrated in U.S. Pat. No. 4,237,560, Riegelman, issued Dec. 9, 1980, and U.S. Pat. No. 5,279,001, Vento, issued Jan. 18, 1994. Both of these patents show most of the components required to provide the bidet operation, within the confines of the toilet seat, that is a water warmer, pressure regulator, and even a hot air fan for drying purposes. Various controls are provided in the toilet seat to allow for control of temperature and pressure of the water being delivered.

U.S. Pat. No. 5,279,001, Vento, in particular, describes a telescopic nozzle which will project from the toilet seat only when water pressure is applied to the nozzle, i.e. when it is in use. It is believed, however, that the telescopic parts of the nozzle in the Vento toilet seat bidet assembly will allow dirt to accumulate in the exposed joints or interfaces of the various parts. It is also considered that, since the various bidet parts are now in the toilet seat that the toilet seat will be heavier than a conventional toilet seat and this weight will contribute to breakage of the toilet seat and/or injury to a person who accidentally tips the toilet seat from an upright position to its horizontal position.

SUMMARY OF THE INVENTION

The present invention comprises a thin profile toilet seat which is hollow and includes a water source means, flow control means, pressure regulator means, a water heater, and at least a flow directing nozzle, the nozzle being a retractable nozzle in a rear portion of the seat and to project, from the toilet seat, a distance from a rear edge of the toilet seat during operation, and then when water flow is shut off the nozzle will automatically retract within the toilet seat, to be completely withdrawn within the seat in a chamber defined in the seat, the seat including a door to close the chamber when the nozzle is retracted.

In another aspect of the invention a mounting plate is provided which can be adjusted to varying standard, porcelain bowls for mounting toilet seats and a rupturable connection is provided between the hinged plate assembly and the toilet seat so as to avoid damage to the toilet seat if the toilet seat should receive a shock sufficient to dislodge it.

In a still further aspect of the present invention, a friction brake-clutch combination is provided to allow easy lifting of a toilet seat but to allow a damping control for lowering of the toilet seat.

Other objects and advantages will be apparent from the following description and the accompanying drawings.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a perspective view, partly in dotted lines, of a toilet with a bidet toilet seat combination incorporated thereon;

FIG. 2 is a top plan view of a toilet seat-bidet assembly with the lid closed thereon;

DESCRIPTION OF THE PREFERRED EMBODIMENTS

Figure 3:
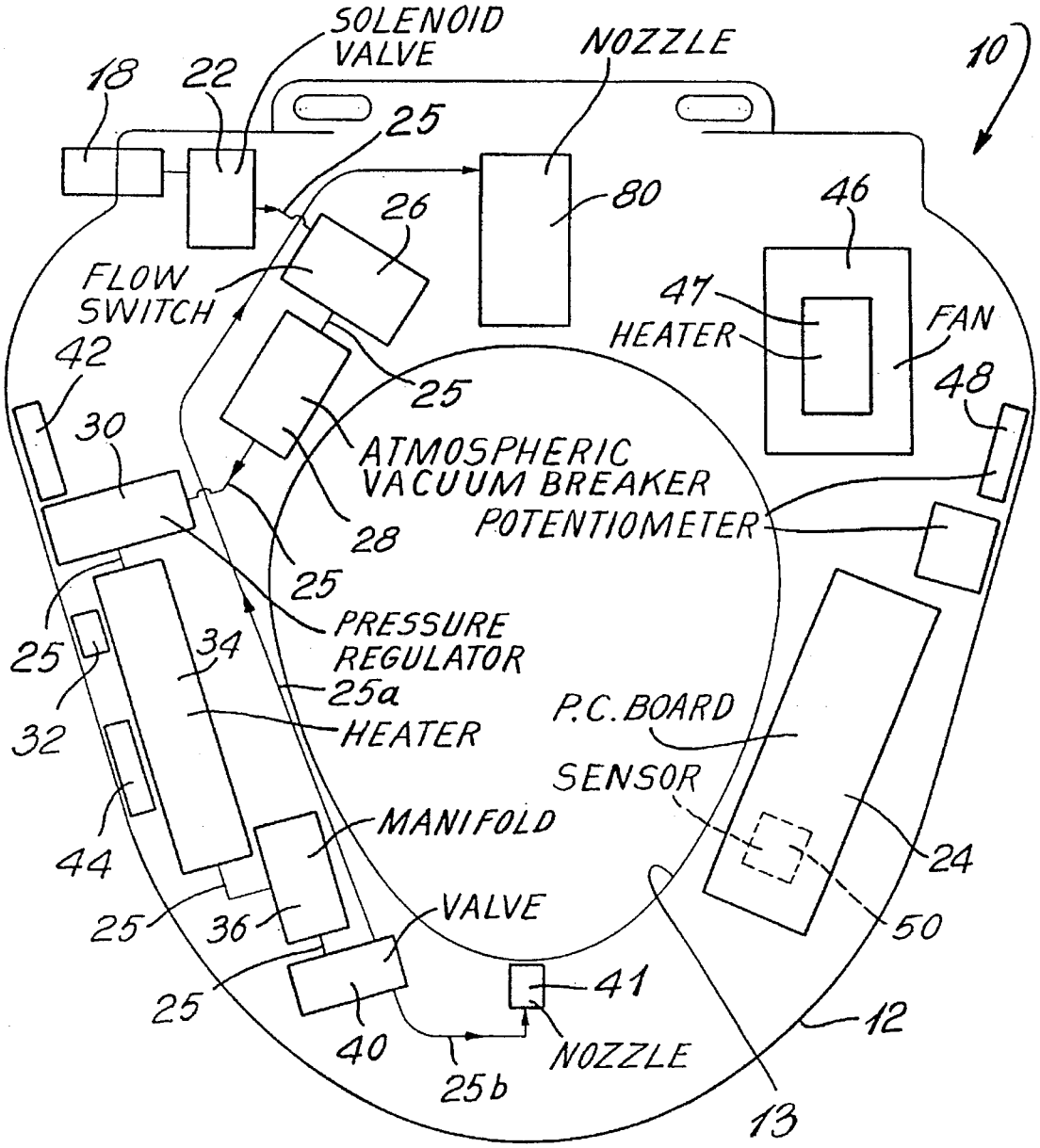
FIG. 3 is a schematic top plan view showing the various elements as they would be arranged in the toilet seat.

Referring now to the drawings: a toilet 9 has a toilet seat and bidet assembly 10 with a toroid seat 12, a cover 14, and a hinge mechanism 16. The toroid seat defines an opening 13 as is common.

As seen in FIGS. 1 and 2, there is shown a swivel joint 18 including a water source inlet 20. The swivel joint 18 allows for a rotating joint between the bathroom plumbing and the toilet seat assembly 10, and thus reduces the stress on the toilet seat and the incoming water supply hose.

Referring to the schematic illustration in FIG. 3, water passes through the swivel joint 18, then flows through a solenoid valve 22 controlled by the PC board 24. The solenoid valve 22 is normally closed.

The water line 25 extends from valve 22 to a flow switch 26. The flow switch 26 senses if there is sufficient flow to allow the water heater to be activated. If there is insufficient flow of water in the line 25 due to external causes, the flow switch 26 will sense the reduced flow and prevent the heater from being turned on.

The water then flows through line 25 to an atmospheric vacuum breaker 28 which prevents water from flowing back in the line. For instance if water were to back up in the toilet and for some reason get into the toilet seat water circuit, the breaker 28 would prevent water from flowing back into the main line. This is especially important if the water is contaminated.

The water line 25 then passes to the pressure regulator 30 associated with a control knob 32. The pressure regulator 30 allows the user to control the water flow directly, upon turning the knob 32.

The line 25 passes to the water heater 34 which is an elongated cylinder with a heater element within the cylinder. A thermal fuse is also provided with the water heater 34. If the water temperature should rise to a very high level for instance, the thermal fuse would shut down the water heater 34 and it is not resettable. The toilet seat assembly 10 would have to be returned to the manufacturer for repair.

The heated water flows from the heater 34 into a manifold 36. The manifold 36 has a built in a thermocouple which is a temperature sensing device. This thermo-couple sends a signal indicating the water temperature to the PC board 24 to adjust the water heater. An independent thermostat is also provided in the manifold which would cut off the water in the event that the water was too hot and above a certain preset limit. This is an additional back-up to the thermocouple as is the fuse in the water heater 34, and merely shuts the power to the heater 34.

The line 25 passes to a diverter valve 40. The diverter valve 40 allows the user to direct water through line 25*a* to the rear nozzle 80 or to the front nozzle 41 through line 25*b* by means of the control buttons 42 and 44 on the side of the seat 12.

On the other side of the seat there is a rotary blower 46 and a coil heater 47 sits on top of the blower 46. A thermal fuse is also provided to prevent the heater 47 from overheating the air. Also on the side of the seat is a potentiometer 48 controlling the blower fan 46.

An electrical cord 47 comes in at the rear of the seat 10 behind the blower 46. A pressure sensitive button 50 is located below the seat to detect whether someone is sitting on the seat or not. When the toilet seat is lifted, no water or any of the electrical controls can be activated. The purpose of this sensor button 50 is to avoid nuisance use by children, etc.

The PC board 24 includes the power supply, controlling circuit, and software.

Figure 4:
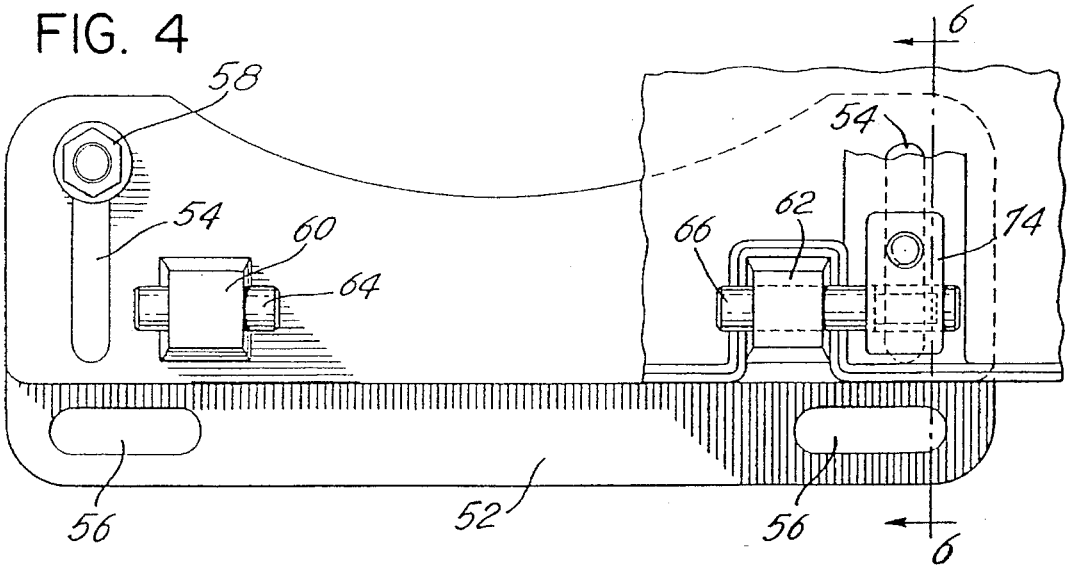
FIG. 4 is a top plan view of an element of the embodiment shown in FIG. 1.
Figure 5:
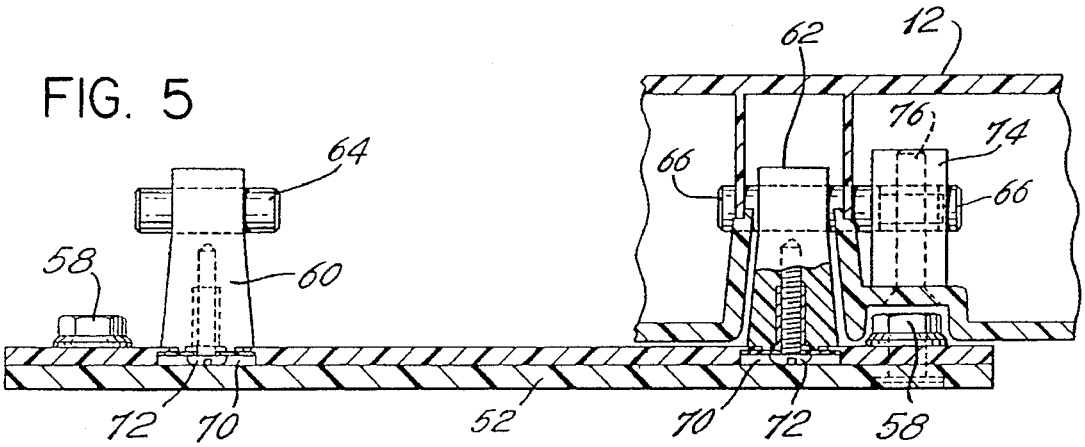
FIG. 5 is a vertical view, partly in cross-section, of the element shown in FIG. 4.

FIGS. 4 and 5 show the hinge mechanism 16 including a slotted mounting plate 52 having longitudinal slots 54 and lateral slots 56. A stud/nut combination 58 allows the mounting plate 52 to be mounted on different toilet bowls, either long or short. At the same time slots 56 allow the plate 52 to fit on many toilets since the porcelain openings for the mounting studs can vary in different countries.

Pedestals 60 and 62 located on mounting plate 52 are provided with hinge shafts 64 and 66 respectively. These shafts are generally placed in the mold when the pedestals 60 and 62 are being molded so that the shafts 64 and 66 are an integral part of the pedestals 60 and 62.

Figure 8:
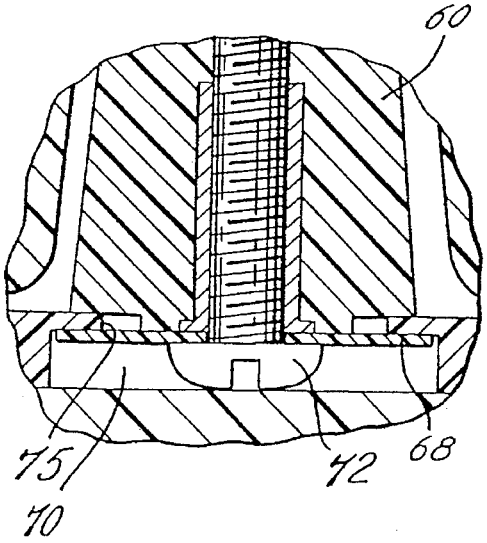
FIG. 8 and FIG. 8*a* are enlarged fragmentary cross-sections of a detail of the element shown in FIGS. 4 and 5 and illustrated in different positions.
Figure 8A:
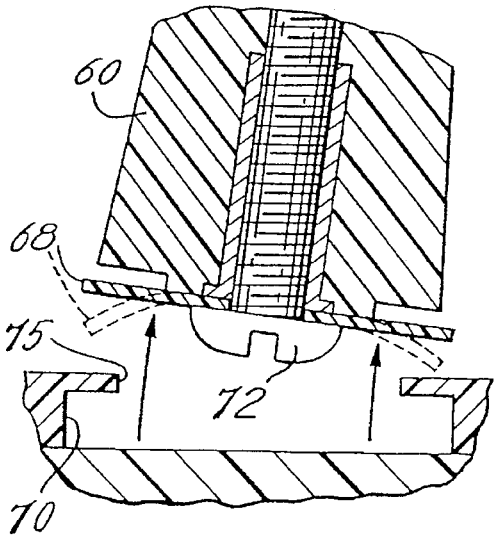

As shown in FIGS. 8, and 8*a*, the pedestal 60 is shown having a deformable washer 68 which engages within a recess 70 when the bolt 72 has been fastened from underneath a portion of the mounting plate 52. A smaller opening 75 is shown and this opening has a square outline. If a shock is subjected to the pedestal 60, for instance, the washer 68 will deform and pass through the opening 75 whereby the toilet seat 10 will be detached from the mounting plate 52 undamaged. The seat 10 must then be remounted to the plate 52.

Figure 6:
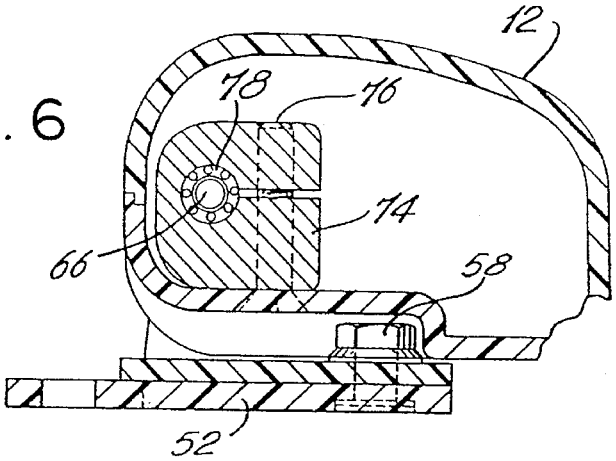
FIG. 6 is a fragmentary vertical cross-section taken along the lines 6—6 of FIG. 4.

A special friction drum brake 74 is located on part of the shaft 66 as shown in FIGS. 5 and 6. In this case the shaft 66 has a smaller diameter then the portion of the shaft within the pedestal 62, and a roller clutch 78 is provided on the shaft. The drawn cup roller clutch 78 is manufactured by the Torrington Company. The drum brake 74 can be adjusted by means of the adjustment bolt 76. The roller clutch 78 will allow the upward rotation of the toilet seat 10 to be effortless while the brake will engage the shaft 66 in a downward rotation of the toilet seat 10, by gravity or otherwise, in order to dampen the movement thereof and to avoid shock of the seat 10 as it comes down on the porcelain toilet bowl.

Figure 7:
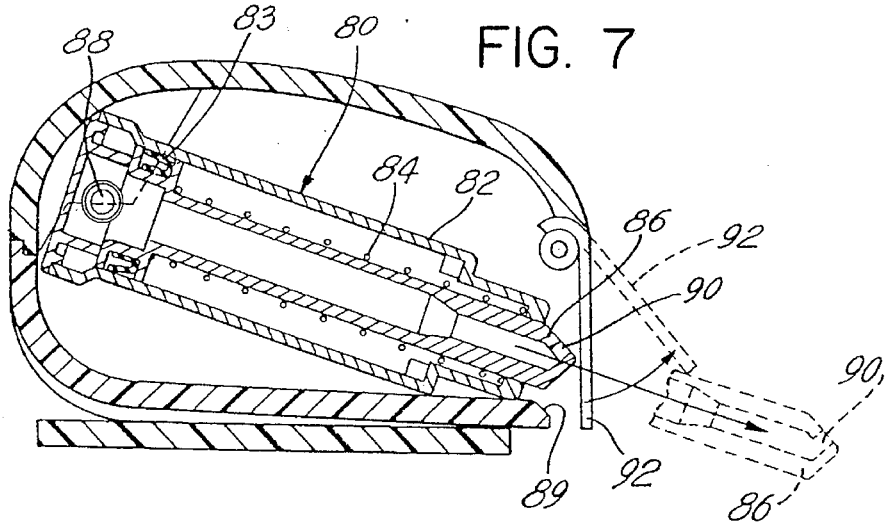
FIG. 7 is a vertical cross-section taken through the rear nozzle, one of the elements of the embodiment shown in FIG. 1.

As shown in FIG. 7 the retractable rear water nozzle assembly 80 operates with water pressure. The nozzle assembly 80 includes a cylinder 82 and a coil spring 84 surrounding the piston-like nozzle 86. The piston-like nozzle 86 can slide in the cylinder 82 against the spring 84 when water pressure enters the inlet 88. An annular gasket 83 seals the piston to the cylinder 82 during the sliding movement. At the other end of the piston-like nozzle 86 are several openings 90 which provide spray jets.

Figure 9:
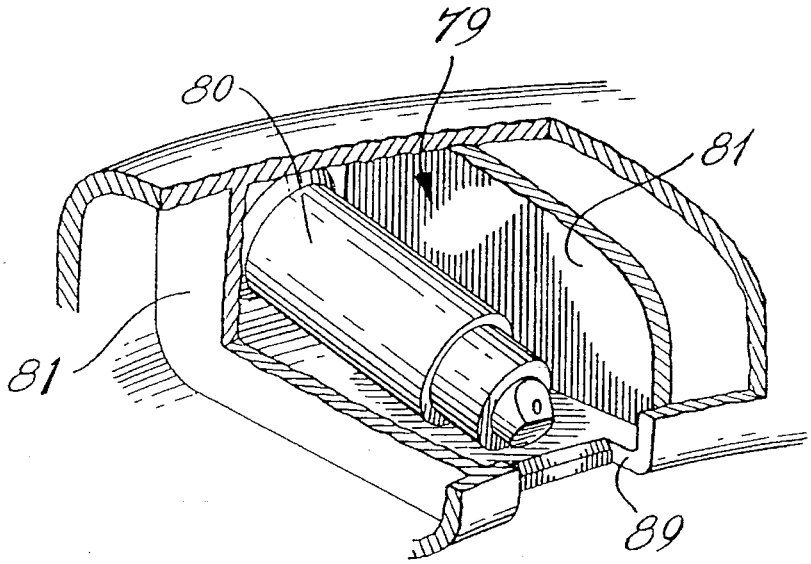
FIG. 9 is a fragmentary perspective view of the detail shown in FIG. 7.

As shown in FIGS. 7 and 9, a chamber 79 is formed in the rear of the toilet seat 12 and is delimited by side walls 81. An opening 89 is defined in the front wall of the rear portion of the seat 12 and a door 92 closes an opening 89, through which nozzle 86 will project when activated. The door 92 is hinged to the seat 12 over the opening 89 to allow the door 92 to close by gravity.

Thus, when the water flow is allowed to enter the piston-like nozzle 86 it will advance the nozzle against the spring 84 through the opening 89 pushing the door 92 open. The nozzle 86 will reach the position shown in dotted lines in FIG. 7. From there the water jets will be directed to the proper anatomical location by means of the angle of the nozzle 86 and the direction of the openings 90.

The door 92 is normally closed when the nozzle 86 is not activated. When water flow is initially directed to nozzle assembly 80 it will first slowly spray out from the openings 90 into the chamber 79, thus cleaning the nozzle assembly 80 before it becomes fully activated.

A remote control may be used to control the various switches and this is not shown. In this case the remote control which is infra red operated has four switches which are normally indicated by visual symbols. The remote control can be battery operated.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A bidet and toilet seat assembly comprising a thin profile, hollow toilet seat that defines a central opening, water conduit, within the hollow seat for communicating water from a water source, water jet means connected to the conduit means and extending within the central opening of the toilet seat for spraying water, flow control means for controlling water flow and pressure regulator means for controlling water pressure in said conduit means, said conduit means communicating with a water heater, said water jet means having at least a retractable nozzle movable between a retracted position within a chamber defined in the hollow toilet seat and an operative position projecting from an inner edge of said toilet seat, the toilet seat defining an opening at the inner edge of the seat through which the nozzle projects, and a hinged door closes the opening when the nozzle is retracted.

2. The bidet and toilet seat assembly as defined in claim 1, wherein the retractable nozzle is located at a rear of the toilet seat.

3. The bidet and toilet seat combination as defined in claim 1, wherein the door is hinged at a top of the opening in order to allow the door to be closed by gravity.

4. The bidet and toilet seat assembly as defined in claim 1, wherein the retractable nozzle includes a first cylinder, inlet means provided at one end of said cylinder to receive the water conduit means, a nozzle member having gasket means and being slidable within the cylinder away from the inlet, and spring means surrounding the nozzle member and within the cylinder so that the spring means urges the nozzle member to retract into the cylinder, and such that when water is fed under pressure through the inlet means the water pressure forces the nozzle member to project from the cylinder into the interior of the central opening formed by the toilet seat, causing the door to open.

5. The bidet and toilet seat combination as defined in claim 4, wherein the nozzle member includes at least one jet opening extending upwardly at an angle to a sliding axis of the nozzle member.

6. The bidet and toilet seat assembly as defined in claim 1, wherein the toilet seat is annular, the assembly further including a toilet seat mounting plate for mounting the toilet seat to a porcelain toilet bowl, the mounting plate including a pair of pedestals having hinge shafts to which the toilet seat is hingedly mounted, and each pedestal is mounted to the mounting plate by a bolt and a washer, the bolt passes through an opening in the mounting plate, the washer being deformable and having a dimension greater than the opening such that when force is applied to the pedestal the deformable washer will pass through the opening before the pedestal will break.

7. The bidet and toilet seat assembly as defined in claim 1, wherein the toilet seat is hingedly mountable to a porcelain toilet rim, the assembly further including a mounting plate, the mounting plate including at least a pair of pedestals with hinge shafts for hingedly mounting the toilet seat, at least one of the pedestals including a clutch and brake mechanism between the shaft and the toilet seat so that the toilet seat can be raised without resistance and pivoting movement of the toilet seat in a downward direction will be dampened.

* * * * *